US005503690A

United States Patent [19]

Wade et al.

[11] Patent Number: 5,503,690

[45] Date of Patent: Apr. 2, 1996

[54] METHOD OF EXTRUDING A 6000-SERIES ALUMINUM ALLOY AND AN EXTRUDED PRODUCT THEREFROM

[75] Inventors: Kenneth D. Wade, Midlothian; Michael H. Skillingberg, Richmond, both of Va.

[73] Assignee: Reynolds Metals Company, Richmond, Va.

[21] Appl. No.: 220,125

[22] Filed: Mar. 30, 1994

[51] Int. Cl.[6] ..... C22F 1/04

[52] U.S. Cl. ..... 148/550; 148/689; 148/690; 148/439; 420/535

[58] Field of Search ..... 148/550, 689, 148/690, 439; 420/534, 535, 537, 541, 543, 544, 551, 553

[56] References Cited

U.S. PATENT DOCUMENTS

| | | | |
|---|---|---|---|
| 3,935,007 | 1/1976 | Baba et al. | 420/535 |
| 4,113,472 | 9/1978 | Fister, Jr. et al. | 420/535 |
| 4,511,632 | 4/1985 | Toma et al. | 420/535 |
| 4,589,932 | 5/1986 | Park | 148/690 |
| 4,711,762 | 12/1987 | Vernam et al. | 148/690 |
| 4,718,948 | 1/1988 | Komatsubara et al. | 148/552 |
| 4,908,184 | 3/1990 | Kaifu et al. | 420/535 |

FOREIGN PATENT DOCUMENTS 57-203742 12/1982 Japan .

OTHER PUBLICATIONS

Ohori, et al. "Proceedings of the Third International Aluminum Extrusion Technology Seminar", vol. 1, pp. 63–67; Atlanta, 1984.

*Primary Examiner*—David A. Simmons
*Assistant Examiner*—Robert R. Koehler
*Attorney, Agent, or Firm*—Alan M. Biddison

[57] ABSTRACT

In a method of extruding a 6000-series-type aluminum alloy by casting, homogenizing, extruding and optionally, aging and/or heat treating, an alloy composition is provided having silicon 0.6–1.2 wt. %, magnesium 0.7–1.2 wt. %, copper 0.3–1.1 wt. %, manganese 0.1–0.8 wt. %, zirconium 0.05–0.25 wt. %, up to 0.5 wt. % iron, up to 0.15 wt. % chromium, up to 0.25 wt. % zinc, up to 0.10 wt. % titanium with the balance aluminum and incidental impurities wherein an effective amount of zirconium, in combination with effective amounts of manganese, produces a fibrous grain structure which contributes to a combination of high strength and fracture toughness in the extruded alloy. The fibrous grain structure also permits improvements in forming the extrusion by enabling lower temperatures to be utilized during the homogenization step. In extruding this 6000-series-type aluminum alloy, a final product is produced having improved combinations of strength and fracture toughness for use in structural applications or the like.

8 Claims, 2 Drawing Sheets

Prior Art

METHOD OF EXTRUDING A 6000-SERIES ALUMINUM ALLOY AND AN EXTRUDED PRODUCT THEREFROM

FIELD OF THE INVENTION

The present invention is directed to a method of extruding 6000-series-type aluminum alloys and products produced thereby and, in particular, to a 6000-series-type aluminum alloy containing controlled amounts of zirconium and manganese to form an extruded product combining both high strength and high toughness.

BACKGROUND ART

In the prior art, AA6000 series aluminum alloys are in increasing demand for structural applications given their desirable mechanical properties of high strength, corrosion resistance and extrudability. These heat treatable aluminum alloys have a wide variety of potential applications including automotive components such as vehicular panels and structural frame members. Examples of these types of aluminum alloys, particularly useful as extrusions, include AA6061, AA6063 and AA6013. Prior to the development of AA6013, AA6061 exhibited the highest strength levels for extrusion purposes.

The compositional limits of AA6013 are identified in U.S. Pat. No. 4,589,932 to Park. AA6013, differing from AA6061 primarily through increased levels of copper and manganese, is reported to exhibit higher strengths than AA6061.

FIG. 1 shows the typical processing steps disclosed in the Park patent for extruding AA6013. The alloy is cast, homogenized and preheated prior to the extrusion step. In order to achieve the improved mechanical properties, the homogenization treatment is practiced at temperatures near the solidus temperature. A minimum of 1,010° F. is identified.

The homogenized and pre-heated billet is then extruded and rapidly cooled followed by a conventional aging treatment to obtain the final extruded product.

However, with the ever increasing demand for improved properties for 6000-series-type aluminum alloys, in particular, extrusions for automotive structural applications, a need has developed to provide methods and alloy compositions which provide improved mechanical properties such as a combination of high strength, high fracture toughness and corrosion resistance. Moreover, improvements are required in processing techniques to achieve increased savings in energy and reductions in operating costs.

In response to this need, the present invention provides both a novel aluminum alloy composition of the 6000-series-type for extrusion as well as improvements in processing techniques for extruding the inventive alloy composition.

SUMMARY OF THE INVENTION

Accordingly, it is a first object of the present invention to provide a method of extruding a 6000-series-type aluminum alloy which yields savings in energy consumption and operating costs through improved heat treatment.

Another object of the present invention is to provide a 6000-series-type aluminum alloy composition having controlled amounts of zirconium and manganese for improved properties.

A further object of the present invention is to provide an extruded product made from a 6000-series-type aluminum alloy which combines high strength and toughness and, in particular, provides improvement in mechanical properties over an AA6013 aluminum alloy.

Other objects and advantages of the present invention will become apparent as a description thereof proceeds.

In satisfaction of the foregoing objects and advantages, the present invention is an improvement over 6000-series-type aluminum alloys such as AA6013 and known methods of extruding these aluminum alloy compositions.

In a first aspect of the present invention, an aluminum alloy composition is provided in the following weight percentage ranges:

Si-0.6–1.2%
Mg-0.7–1.2%
Cu-0.3–1.1%
Mn-0.1–0.8%
Zr-0.08–0.25%
Fe-0.5% max
Cr-0.15% max
Zn-0.25% max
Ti-0.10% max
Incidental Impurities
  Each 0.05% max
  Total 0.15% max
  Al-balance In another aspect of the invention, the inventive alloy composition identified above is utilized in a method of making 6000 series-type aluminum alloy extrusions wherein the aluminum alloy is cast, homogenized, extruded and, optionally, heat treated to produce a final extruded product. According to the invention, the inventive alloy composition is homogenized after the casting step and prior to extrusion at a temperature not greater than about 1,000° F. for a predetermined period of time. Homogenizing the cast aluminum alloy at temperatures in excess of this maximum adversely affects the improved mechanical properties which are the result of controlled amounts of alloying elements, particularly zirconium and manganese, in the extruded product.

The zirconium and manganese in the inventive alloy composition function to create a highly elongated unrecrystallized grain structure in the extruded product and contribute to the improved combination of high strength and high fracture toughness.

In the more preferred embodiment, the alloy composition has the following weight percent ranges:

Si-0.6–1.0%
Mg-0.8–1.2
Cu-0.6–1.1%
Mn-0.2–0.8%
Zr-0.08–0.20%
Fe-0.50% max
Cr-0.10% max
Zn-0.25% max
Ti-0.10% max
Al-balance Alternatively, if a more weldable and castable extrusion is desired, the inventive alloy can include the following weight percentage ranges:

Si-0.70–90%
Mg-1.00–1.20%

Cu-0.35–0.55%
Mn-0.20–0.50%
Zr-0.08–0.18%
Fe-0.10–0.30%
Cr-0.03–0.13%
Zn-0.10% max
Ti-0.05% max
Al-balance

BRIEF DESCRIPTION OF THE DRAWINGS

Reference is now made to the accompanying drawings wherein.

DESCRIPTION OF THE PREFERRED EMBODIMENTS

Figure 1:
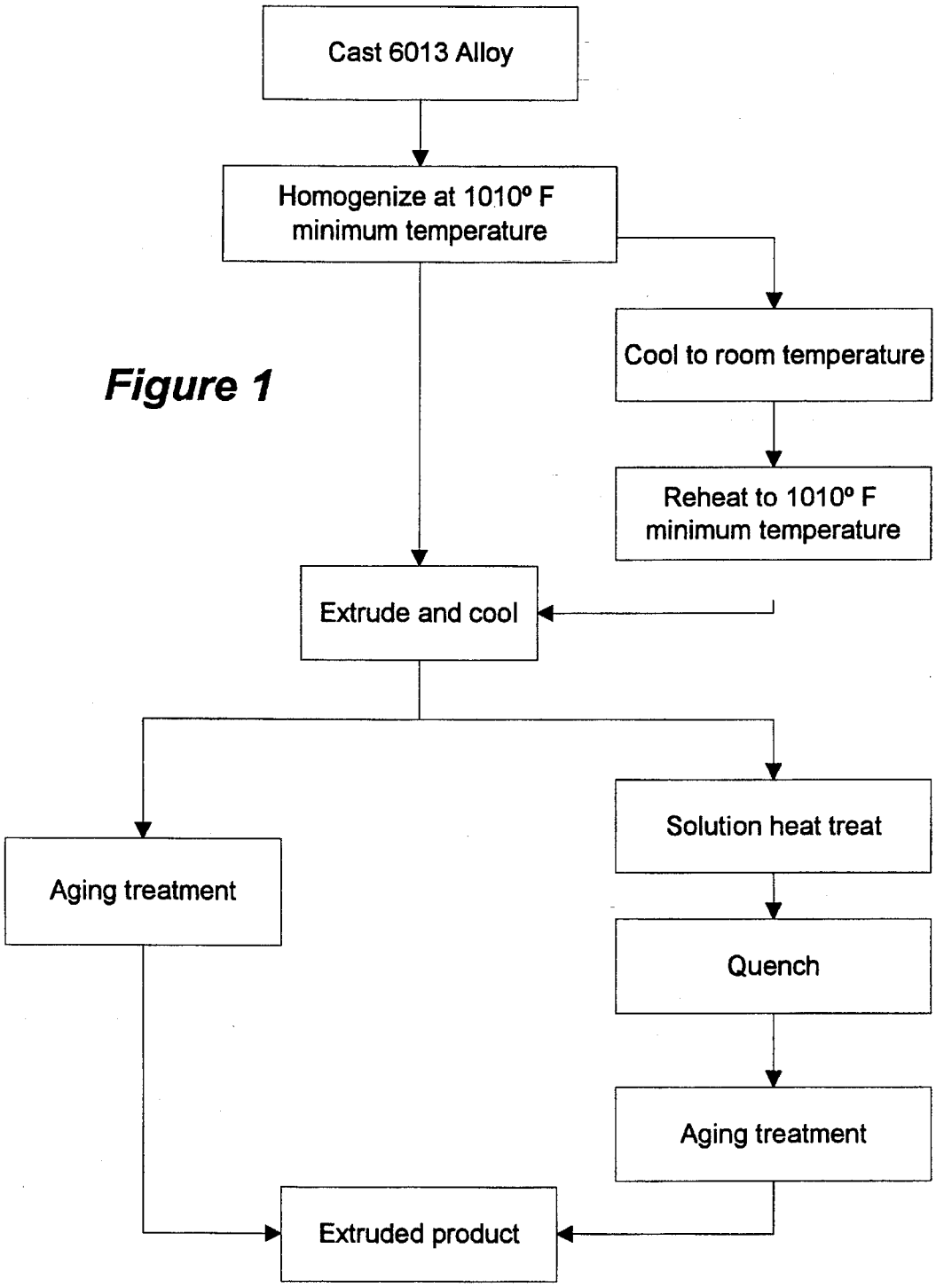
FIG. 1 is a schematic diagram of a prior art extrusion method.

The present invention provides a method which produces an extruded product which is an improvement over existing 6000-series-type aluminum alloys such as AA6013 or AA6061. The inventive extruded product, by heat treatment and/or control of alloying elements, effectively combines both high strength and high toughness to meet more stringent product specifications found in the aircraft, aerospace and automotive industries.

The combination according to the invention of control of alloying elements in the alloy composition and thermal practices creates a fibrous grain structure in the as-extruded condition. This fibrous structure enhances the mechanical properties of the as-extruded product when subjected to subsequent conventional processing such as aging or aging in combination with solution heat treatment.

Furthermore, control of heat treating of the inventive alloy prior to extrusion contributes to retention of the fibrous grain structure and improved mechanical properties when subjected to further conventional processing. The controlled heat treating also provides improvement over prior art methods by using lower heat treating temperatures, thereby providing energy and operating cost savings during processing.

Use of a reduced billet preheat homogenization temperature prior to extruding an aluminum alloy to produce a high strength high toughness extrusion is contrary to prior art conventional practice. In U.S. Pat. No. 4,589,932, castings are homogenized at a minimum temperature of a 1,010° F. prior to extrusion. Heat treating temperatures above this minimum are required to achieve the reported combination of exfoliation corrosion resistance and improved strength and toughness. As will be demonstrated hereinafter, using the alloy composition and novel processing according to the invention produces an extrusion with improved toughness over an AA6013 alloy with the same levels of strength.

In its broadest embodiment, the inventive method employs a 6000-series-type aluminum alloy for extrusion purposes of the following weight percentage ranges:

Si-0.6–1.2%
Mg-0.7–1.2%
Cu-0.3–1.1%
Mn-0.1–0.8%
Zr-0.08–0.25%
Fe-0.5% max
Cr-0.15% max
Zn-0.25% max
Ti-0.10% max
Al-balance More preferably, the alloy composition consists essentially of:

Si-0.6–1.0%
Mg-0.8–1.2%
Cu-0.6–1.1%
Mn-0.2–0.8%
Zr-0.08–0.20%
Fe-0.50% max
Cr-0.10% max
Zn-0.25% max
Ti-0.10% max
Al-balance If castability and weldability in the extruded product are also desired, a preferred alloy composition for use in the inventive method consists essentially of:

Si-0.70–0.90%
Mg-1.00–1.20%
Cu-0.35–0.55
Mn-0.20–0.50%
Zr-0.08–0.18%
Fe-0.10–0.30%
Cr-0.03–0.13%
Zn-0.10% max
Ti-0.05% max
Al-balance If weldability is not a concern, an alloy composition consisting essentially of the following can be used:

Si-0.65–0.80%
Mg-0.85–1.05%
Cu-0.80–1.00%
Mn-0.4–0.7%
Zr-0.08–0.18%
Fe-0.30% max
Cr-0.08% max
Zn-0.10% max
Ti-0.08% max
Al-balance It should be understood that the above-listed compositional ranges also include incidental elements and impurities typically found in 6000-series-type aluminum alloys, preferably no individual impurity exceeds 0.05% max and the total does not exceed 0.15% max.

In the compositions described above, the zirconium levels are controlled in conjunction with manganese to create and retain a fibrous grain structure. The zirconium in combination with the manganese promotes the retention of the fibrous grain structure after hot working and solution treating. This fibrous grain structure can be characterized as a highly elongated unrecrystallized grain structure which is stabilized by the presence of zirconium and manganese. Stabilization of the unrecrystallized grain structure also permits use of a lower temperature homogenization treatment to develop improved combinations of high strength and high toughness in the final extruded product.

The presence of zirconium in the alloy composition is believed to result in the formation of aluminum-zirconium particles. These particles are significantly smaller than other dispersoids in the 6000-series-type alloying system such as Al—Fe—Si type and manganese-rich particles. Consequently, the fibrous grain structure is more resistant to recrystallization upon working and/or heat treating, thereby providing an extruded product having both high strength and high toughness.

The inventive alloy composition can also include chromium which further enhances the resistance to recrystallization in combination with zirconium and manganese.

In an alternative embodiment, the copper content is reduced to the range of 0.35 to 0.55 to make the extruded product more weldable and improve extrudability and cold workability by lowering tensile properties.

Figure 2:
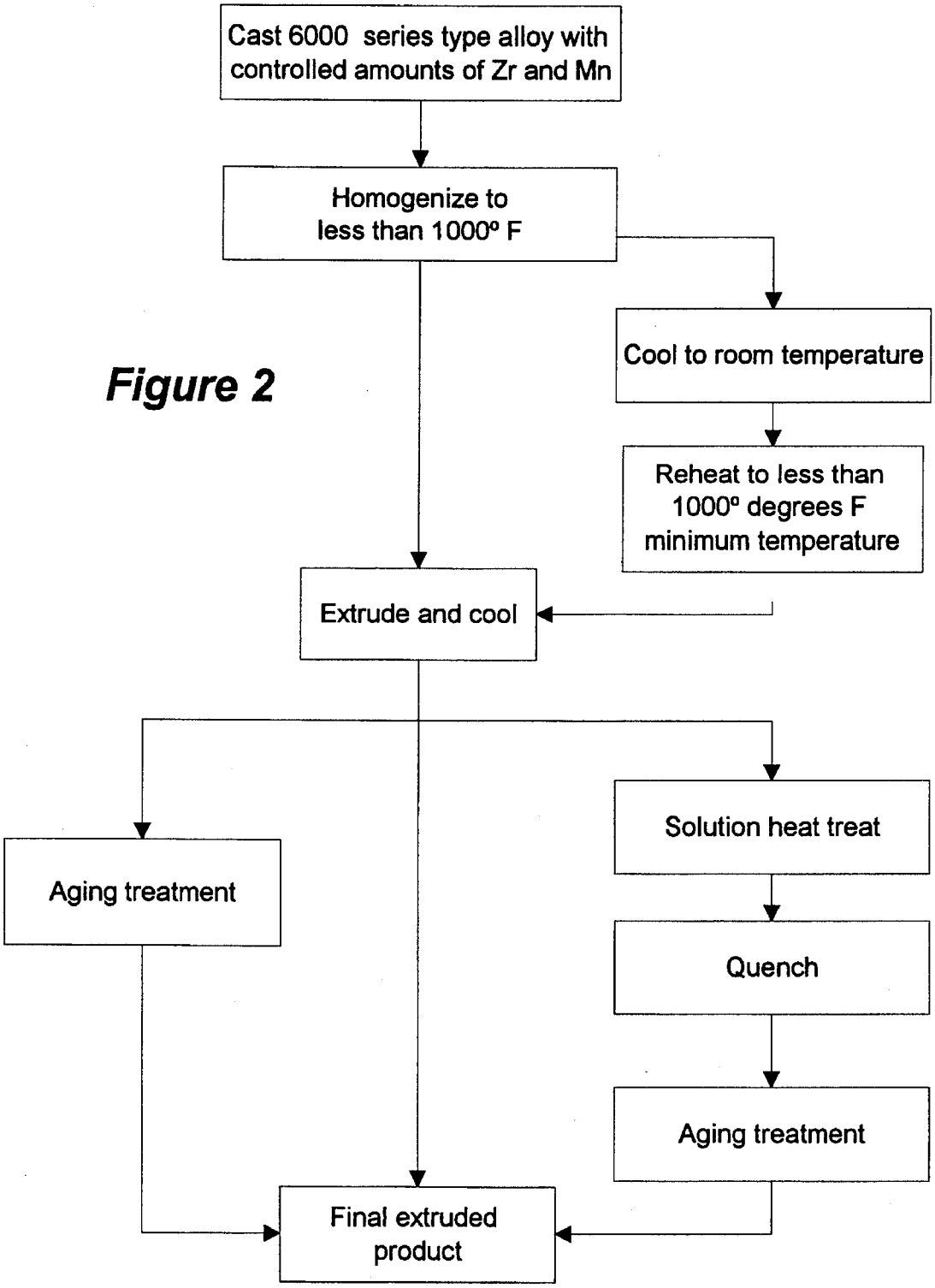
FIG. 2 is a schematic diagram of an extrusion process according to the invention.

With reference to FIG. 2, a schematic outlining the method of the invention identifies the principle steps of casting, homogenizing, extruding and an optional aging treatment to produce the final extruded product.

It should be understood that the casting, extruding and aging treatments are conventional in the field of processing 6000-series aluminum alloys and, therefore, specific operating parameters are not disclosed herein.

As stated above, the combination of zirconium and manganese in the cast alloy permits the use of a homogenization temperature not exceeding 1000° F. With this homogenization step, the fibrous grain structure or unrecrystallized grain structure formed by the extrusion process is retained in the final extruded product and contributes to the improvements in strength and toughness over known 6000-series-type aluminum alloys.

Billets of the inventive alloy can be cast in any diameter and homogenized at 1,000° F. for between 4 and 36 hours or for about 8 to 36 hours, preferably 18 hours. However, the homogenization time can vary depending on billet size, configuration and other known parameters. Different configurations of castings can also be used to produce the desired extrusion shape.

Following homogenization, the billets are preheated and extruded to a desired configuration. Typically, the billets are preheated at temperatures between about 880° to 980° F. and the extruded products are cooled by water spray quenching after being extruded.

The as-extruded products can be given any conventional aluminum alloy aging or heat treatment processing, including natural aging, aging at selected temperatures and times or solution heat treating followed by aging at selected temperatures and times.

It should be understood that the inventive alloy can be extruded in any configuration including channels, bars, seat rails, I-beams, angles, tubing, architectural shapes, rectangular hollows, rods, or other complex extruded shapes.

In order to demonstrate the surprising combination of high strength and high fracture toughness over known 6000-series alloys using the inventive method and alloy composition, the following experiment was conducted. Unless otherwise mentioned, all percentages of alloying elements are in weight percent. The following is presented to illustrate the invention but is not to be considered as limiting thereto.

In this experiment, a comparison was made between two alloys corresponding to AA6013 designated as 6013-A and 6013-B and two alloy compositions, one falling within the compositional ranges of the inventive alloy, designated as Extrusion-1 and one similar to the inventive alloy but having a zirconium amount above the upper limit, and designated as Extrusion-2. Table I below identifies the actual composition of these four test alloys.

TABLE I

| alloy | Si | Fe | Cu | Mg | Mn | Zn | Ti | Zr | Cr |
|---|---|---|---|---|---|---|---|---|---|
| 6013-A | .74 | .26 | .75 | 1.13 | .53 | .02 | .02 | .01 | .02 |
| 6013-B | .73 | .27 | .75 | 1.07 | .69 | .02 | .02 | .01 | .02 |
| Extrusion-1 | .71 | .29 | .75 | 1.05 | .38 | .03 | .02 | .16 | .03 |
| Extrusion-2 | .72 | .27 | .75 | 1.05 | .30 | .04 | .02 | .28 | .03 |

Extrusion billets of 6 inches diameter were cast with the compositions listed above. The billets for alloys 6013-A and B were homogenized 12 hours at 1,040° F. in accordance with conventional practice. Extrusion-1 and Extrusion-2 were homogenized 18 hours at 1,000° F. Following homogenization, the billets were heated to 900°–930° F. for extrusion. The extrusions were press quenched with water and either naturally aged, artificially aged or solution heat treated at 1,000° F., cold water quenched and artificial aged.

Table II shows a comparison between the prior art 6013 alloys and the inventive alloy with respect to tensile strength, yield strength and percent elongation.

TABLE II

COMPARISON OF STRENGTH AND ELONGATION

| Alloy Designation | thickness (in.)* | UTS (ksi) | YS (ksi) | elong (% in 2") |
|---|---|---|---|---|
| Press quenched and natural aged | | | | |
| Extrusion-1 | 1.0 | 53.8 | 39.5 | 13 |
| Extrusion-2 | 1.0 | 52.8 | 37.7 | 17 |
| 6013-A | 1.0 | 47.0 | 33.2 | 18 |
| 6013-B | 1.0 | 48.5 | 33.6 | 18 |
| Extrusion-1 | 0.125 | 48.7 | 32.6 | 16.5 |
| Extrusion-2 | 0.125 | 48.8 | 32.7 | 17 |
| 6013-A | 0.125 | 43.1 | 27.4 | 16 |
| 6013-B | 0.125 | 45.3 | 29.4 | 16.5 |
| Press quenched and aged 4 hrs at 375° F. | | | | |
| Extrusion-1 | 1.0 | 59.0 | 54.9 | 14 |
| Extrusion-2 | 1.0 | 57.9 | 54.0 | 13.5 |
| 6013-A | 1.0 | 44.4 | 42.8 | 15 |
| 6013-B | 1.0 | 56.4 | 51.9 | 13 |
| Extrusion-1 | 0.125 | 54.6 | 49.5 | 10 |
| Extrusion-2 | 0.125 | 54.6 | 49.6 | 10 |
| 6013-A | 0.125 | 48.5 | 43.7 | 10.5 |
| 6013-B | 0.125 | 51.5 | 45.3 | 11 |
| Solution heat treated 1 hr at 1000° F. and aged 4 hrs at 375° F. | | | | |
| Extrusion-1 | 1.0 | 66.2 | 62.4 | 13 |
| Extrusion-2 | 1.0 | 64.6 | 61 | 14.5 |
| 6013-A | 1.0 | 66.6 | 62.9 | 14.5 |
| 6013-B | 1.0 | 66.2 | 61.9 | 13.5 |
| Extrusion-1 | 0.125 | 58.3 | 52.1 | 9 |
| Extrusion-2 | 0.125 | 55.6 | 49.6 | 9 |
| 6013-A | 0.125 | 49.9 | 43.8 | 13 |
| 6013-B | 0.125 | 48.5 | 43.7 | 10.5 |

*thickness of extrusion

As is evident from Table II, Extrusion-1 and Extrusion-2 provide superior strength levels in the natural aged, artificially aged and solution heat treated and aged conditions over the known 6013 alloy.

TABLE III

AVERAGE CHARPY VALVES FROM .380" THICK SECTION

| Alloy Designation | Charpy Value |
|---|---|
| Press quenched and aged 4 hrs at 375° F. | |
| Extrusion-1 | 2070 |

TABLE III-continued

| AVERAGE CHARPY VALVES FROM .380" THICK SECTION | |
|---|---|
| Alloy Designation | Charpy Value |
| Extrusion-2 | 1379 |
| 6013-A | 1506 |
| 6013-B | 1719 |
| Solution heat treated 1 hr at 1000° F. and aged 4 hrs at 375° F. | |
| Extrusion-1 | 1739 |
| Extrusion-2 | 1191 |
| 6013-A | 1305 |
| 6013-B | 1477 |

Table III compares average Charpy values between the 6013 alloys, Extrusion-1 and Extrusion-2. As is evident from this table, Extrusion-1 having the zirconium addition shows higher impact values over the 6013 alloys which indicates higher fracture toughness. Extrusion-2 shows lower impact values than the 6013 alloys. It is believed that the increased amount of zirconium in Extrusion-2, i.e., 0.28%, which is outside the specified range of 0.05–0.25 wt. % lowers impact toughness because of the presence of relatively course Al—Zr intermetallic particles.

The percentage of fibrous grain structure in the aged extruded product can vary depending on the extrusion configuration and conditions (speed and temperature). An extruded product, in one embodiment of the invention, has an unrecrystallized grain structure in at least 20% of the product thickness in a representative section thereof, the unrecrystallized grain structure contributing to a combination of high strength and toughness. Extrusions having thicker sections will retain a higher percentage of the fibrous grain structure, for example, from 5% up to 100%. Thinner sections typically retain less of the fibrous grain structure but can also have a 100% fibrous grain structure, particularly with higher manganese levels such as 0.50 to 0.84% and at the front end of an extrusion rather than the back end or middle. In this section, lower extrude speeds can be used to improve the structure, as is known to occur in other extrusion alloys.

Extrusion-1, having controlled amounts of zirconium and manganese, inhibits recrystallization during the aging treatments to produce both higher strength and higher toughness in the final extruded product. The higher strength values reported for the materials in the thicker section is believed to be the result of a reduced level of recrystallization during heating.

The results of the study above clearly demonstrate that the presence of zirconium which contributes to the fibrous grain structure or unrecrystallized grain structure produces an extrusion having both higher strength and toughness than AA6013.

A comparison was also made between an alloy composition according to the invention and one containing a minimum amount of manganese. In this comparison, it was found that zirconium without an effective amount of manganese, i.e. 0.06% Mn, did not create the fibrous grain structure in an F temper or after the extrusion was processed in a T6 temper. It was further verified that the fibrous grain structure was only retained in the T6 temper when zirconium was present in an amount of 0.15% in conjunction with manganese levels between 0.48 and 0.84%. Comparative examples using an AA6013 alloy revealed that no fibrous grain structure existed in the T6 temper. This study confirms that zirconium is essential to creating an extruded product having the combination of high strength and high fracture toughness and that manganese must also be present in effective amounts to produce the improved mechanical properties of the extruded shape.

The comparison in Table III also shows that Extrusion-1 exhibits up to about 20% increase in Charpy values over the 6013 alloys. Likewise, for a given thickness and aging, Extrusion-1 exhibits almost a 15% increase in ultimate tensile strength over 6013.

As such, an invention has been disclosed in terms of preferred embodiments thereof which fulfills each and every one of the objects of the present invention as set forth hereinabove and provides a new and improved method for making a 6000-series-type aluminum alloy extrusion having improved strength and fracture toughness and an extruded product therefrom.

Of course, various changes, modifications and alterations from the teachings of the present invention may be contemplated by those skilled in the art without departing from the intended spirit and scope thereof. Accordingly, it is intended that the present invention only be limited by the terms of the appended claims.

What is claimed is:

1. In a method of producing a 6000-series aluminum alloy wherein said aluminum alloy is cast, homogenized, extruded and aged to form an extruded product, the improvement comprising the steps of:

a) casting an aluminum alloy comprising:
Si-0.6–1.2%
Mg-0.7–1.2%
Cu-0.35–0.55%
Mn-0.1–0.8%
Zr-0.08–0.25%
Fe-0.5% max
Cr-0.15% max
Zn-0.25% max
Ti-0.10% max
Al-balance; and b) homogenizing said cast alloy prior to extruding the alloy; and c) extruding and aging the alloy to produce an extruded product having a combination of high strength and high toughness.

2. The method of claim 1, wherein said aluminum alloy consists essentially of:

Si-0.6–1.0%
Mg-0.8–1.2%
Mn-0.2–0.8%
Zr-0.08–0.20%
Fe-0.50% max
Cr-0.10% max
Zn-0.25% max
Ti-0.10% max
Al-balance.

3. The method of claim 1, wherein said aluminum alloy consists essentially of:

Si-0.70–0.90%
Mg-1.00–1.20%
Mn-0.20–0.50%
Zr-0.08–0.18%
Fe-0.10–0.30%

Cr-0.03–0.13%
Zn-0.10% max
Ti-0.05% max
Al-balance.

4. The method of claim 1, wherein said aluminum alloy consists essentially of:

Si-0.65–0.80%
Mg-0.85–1.05%
Zr-0.10–0.18%
Fe-0.30% max
Cr-0.08% max
Zn-0.10% max
Ti-0.08% max
Al-balance.

5. The method of claim 1, wherein said cast alloy is homogenized at a temperature up to 1000° F. for a period of time that ranges between 4 and 36 hours.

6. The method of claim 5, wherein said period of time is about 18 hours.

7. The method of claim 1, wherein said extruded product has an unrecrystallized grain structure in at least 20% of the product thickness in a representative section thereof, said unrecrystallized grain structure contributing to said combination of high strength and toughness.

8. The method of claim 7, wherein said extruded product has said unrecrystallized grain structure throughout.

* * * * *